US007355496B2

(12) United States Patent
Lo Hine Tong et al.

(10) Patent No.: US 7,355,496 B2
(45) Date of Patent: Apr. 8, 2008

(54) FINLINE TYPE MICROWAVE BAND-PASS FILTER

(75) Inventors: Dominique Lo Hine Tong, Rennes (FR); Charline Guguen, Rennes (FR); François Baron, Cesson Sevigne (FR); Jean-Yves Le Naour, Pace (FR)

(73) Assignee: Thomson Licensing, Boulogne, Billancourt (FR)

( * ) Notice: Subject to any disclaimer, the term of this patent is extended or adjusted under 35 U.S.C. 154(b) by 240 days.

(21) Appl. No.: 11/147,957

(22) Filed: Jun. 8, 2005

(65) Prior Publication Data

US 2005/0287977 A1 Dec. 29, 2005

(30) Foreign Application Priority Data

Jun. 9, 2004 (FR) ..... 04 51150

(51) Int. Cl.
*H01P 1/208* (2006.01)

(52) U.S. Cl. ..... 333/208; 333/212; 333/248

(58) Field of Classification Search ..... 333/208, 333/209, 210, 212, 248
See application file for complete search history.

(56) References Cited

U.S. PATENT DOCUMENTS 5,262,739 A * 11/1993 Dalman ..... 333/26
7,292,123 B2 * 11/2007 Tong et al. ..... 333/208

OTHER PUBLICATIONS

Arndt, F., et al. : "The rigorous CAD of aperture-coupled T-junction bandstop-fillers, E-plane circuit elliptic-function filters, and diplexers", Microwave Symposium Digest, 1991. IEEE MTT-S International Boston, MA, USA Jun. 10-14, 1991, New York, NY, USA IEE US , Jun. 10, 1991.

Bornemann, J. : "Selectivity-improved E-plane filter for millimetre-wave applications". Electronics Letters, IEE Stevenage, GB, vol. 27, No. 21. Oct. 10, 1991, pp. 1891-1893.

Ofli E et al Institute of Electrical and Electronics Engineers: "Analysis and design of mass-producible cross-coupled, folded E-plane filters" 2001 IEEE MTT-S International Microwave Symposium Digest (IMS 2001) Phoenix, AZ May 20-25, 2001, IEEE MTT-S International Microwave Sysmposium, New York, NY: IEE, US vol. 3 of 3, May 20, 2001, pp. 1775-1778.

Young, d. et al.: "Intergrated E-plane filters with finite frequency transmission zeros", 24th. European Microwave Conference Proceedings, Nexus Business Communications, GB, vol. 1, Conf. 24, Sep. 5, 1994, pp. 460-465.

* cited by examiner

*Primary Examiner*—Benny Lee
*Assistant Examiner*—Kimberly E Glenn
(74) *Attorney, Agent, or Firm*—Joseph J. Laks; Vincent E. Duffy; Michael A. Pugel

(57) ABSTRACT

The present invention relates to a FINLINE type microwave band-pass filter comprising a waveguide provided with an insulating substrate placed in an E plane of the guide and comprising on at least one of the surfaces, conductive inserts electrically connected to the internal surfaces of the guide which support the substrate and which determine by their dimensions and their positioning on the substrate a Chebyshev type filter response curve. The filter includes at least one cavity in perpendicular short circuit to the substrate, the positioning and the dimensions of the cavity determining a transmission zero on the filter response curve for attenuating the frequencies situated around this zero. Such a filter is used in particular in transmission terminals operating in the Ka band.

6 Claims, 9 Drawing Sheets

FINLINE TYPE MICROWAVE BAND-PASS FILTER

This application claims the benefit under 35 U.S.C.§ 119 of application number 04/51150 filed in France on Jun. 9, 2004.

BACKGROUND OF THE INVENTION

1. Field of the Invention

The present invention relates to microwave band-pass filters, more particularly to filters made of plane E waveguide technology with a printed dielectric insert, the filter being suitable for insertion in a transmission subsystem produced on printed circuit. It applies more particularly to wireless telecommunication systems operating in the millimetric domain and needing to satisfy high spectral purity requirements.

2. Background of the Invention

In the context of wideband bidirectional communications using a geostationary satellite in the Ka band, it is necessary to use, in the terminals intended for the consumer market, an output filter for attenuating the spurious signals located outside the useful band, typically 29.5-30 GHz. This filter must more specifically reject the frequency of the local oscillator, located typically at 28.5 GHz. To satisfy the consumer market requirements, this filter must be inexpensive.

Given the requirements, the use for this of a waveguide type technology according to various methods is known, in particular:

single or multi-mode cavity filters coupled between themselves by inductive or capacitive irises;

evanescent mode filters;

E plane type filters, with metallic inserts or printed dielectric inserts, commonly called FINLINE.

The basic technology used in the present invention relates to the last of the above and is illustrated in FIG. 1.

In FIG. 1, a microwave waveguide 101 of rectangular section is divided into two identical parts by a plane dielectric substrate 102 situated in the E propagation plane of this guide. This substrate offers low losses and is of minimal thickness (less than 0.2 mm for example) so as not to degrade the quality factor of the guide. However, in this figure, and in the other figures, the thickness of the substrate has been shown greatly enlarged for improved legibility.

The substrate 102 comprises on at least one of its sides printed conductors 103 electrically linked to the internal surfaces of the guide which support the substrate 102 and the topology of which determines the response required for the filter. For simplicity, the term "conductive inserts" will be used to describe these conductors electrically linked to the guide.

The main benefit of this technology is that it can be incorporated and interfaced easily with other planar technologies, such as the microstrip or suspended microstrip technologies. This then means that the filtering function can be incorporated in printed circuits on the main board of the transmission system.

The band-pass filter topology most commonly used in the technologies represented in FIG. 1 consists in using n+1 inductive inserts grounded by being electrically linked to the internal surfaces of the guide, where n is the order of the filter. These inserts are spaced at intervals approximately equal to half the guided wavelength and are theoretically printed on a single side of the substrate. However, to minimize the sensitivity of the response of the filter to production tolerances, the inserts are preferably printed roughly identically on both sides of the substrate, but they are still connected to the internal walls of the guide. The response curve for the band-pass filters obtained in this way is of the Chebyshev type.

To obtain the necessary spectral selectivity, a high order filter can theoretically be used. The filter then obtained has large physical dimensions and is highly sensitive to production errors relating to its dimensions. It is therefore in practice very difficult, even impossible, to produce.

The present invention proposes a new microwave band-pass filter structure which can be used in particular to remedy the dimensioning problems while maintaining the high performance levels and low production costs.

SUMMARY OF THE INVENTION

The present invention relates to a FINLINE type microwave band-pass filter comprising a waveguide provided with an insulating substrate placed in an E plane of the guide and comprising on at least one of its surfaces conductive inserts electrically connected to the internal surfaces of the guide which support the substrate and which determine by their dimensions and their positioning on the substrate a Chebyshev type filter response curve, wherein it comprises at least one cavity in short circuit, perpendicular to the substrate, the positioning and the dimensions of the cavity determining a zero of transmission on the filter response curve for attenuating the frequencies situated around this zero.

The term "zero of transmission" is used to mean a total attenuation on the filter response curve, the attenuation being obtained for a given frequency.

Preferably, two cavities which can be of identical or different shapes, are provided, one at the input and the other at the output of the filter. Each cavity has a length equal to half the guided wavelength $\lambda g/2$ calculated at the given frequency, the guided wavelength being dependent on the section of the guide. According to an embodiment variant, a single cavity provided with a means for adjusting its resonance frequency to the required frequency is provided at the input of the filter. The means for adjusting the resonance frequency is, for example, an adjusting screw.

According to another characteristic of the present invention, the filter is connected by an inductive loop (only the lines linked to a processing circuit of microstrip technology. The circuit of microstrip technology comprises, on the same insulating substrate as the one receiving the conductive inserts, an impedance matching line or quarter-wave line and a 50 Ohm characteristic impedance line.

According to yet another characteristic of the invention for reducing the overall length of the filter, the cavities in short circuit are placed perpendicularly to the inductive loops.

BRIEF DESCRIPTION OF THE DRAWINGS

Other characteristics and advantages of the present invention will become apparent on reading the description of the different embodiments, this description being given with reference to the appended drawings in which.

To simplify the description, in the figures, the same elements are given the same references.

DESCRIPTION OF THE PREFERRED EMBODIMENTS

A first embodiment of a FINLINE type E plane band-pass filter according to the present invention is described first with reference to FIGS. 2 to 6.

Figure 1:
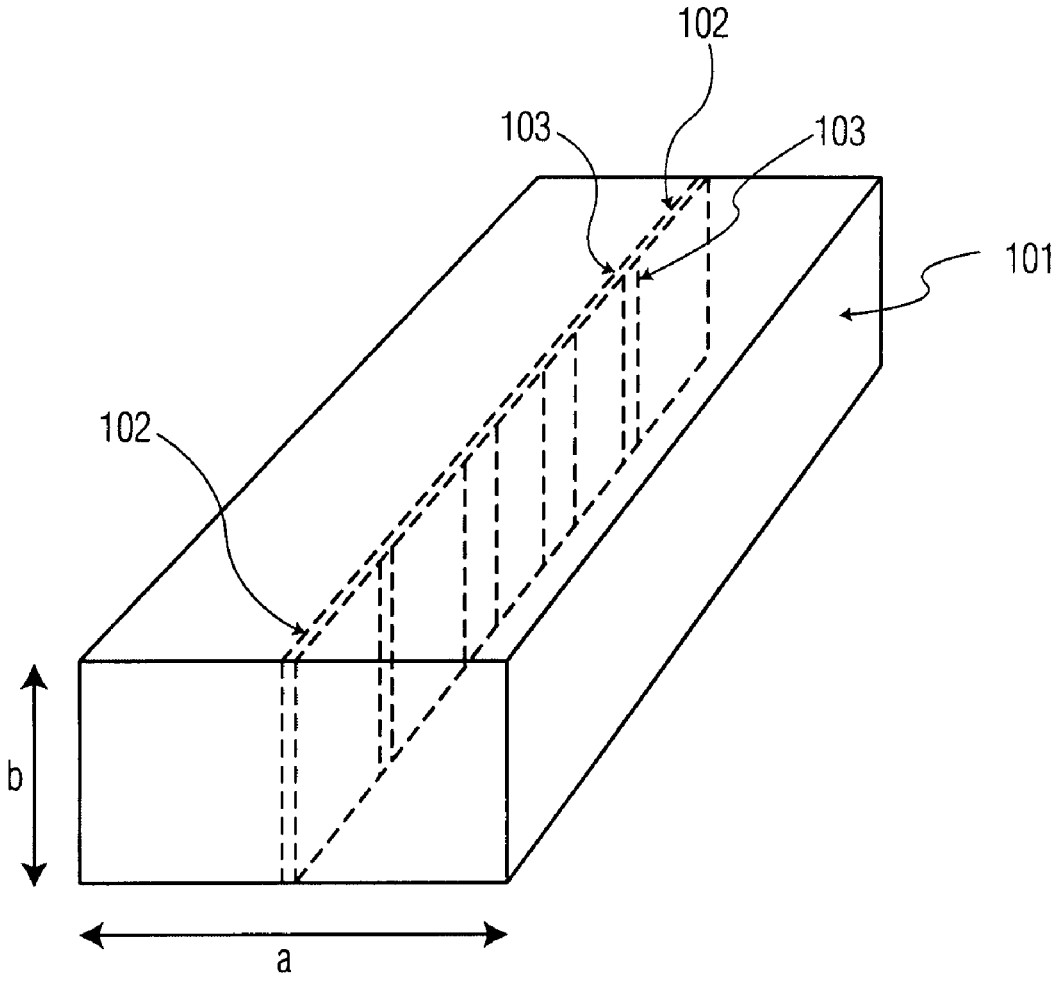
FIG. 1 (Prior Art)
FIG. 1 already described, shows a schematic perspective view of a FINLINE type E plane band-pass filter according to the prior art.
Figure 2:
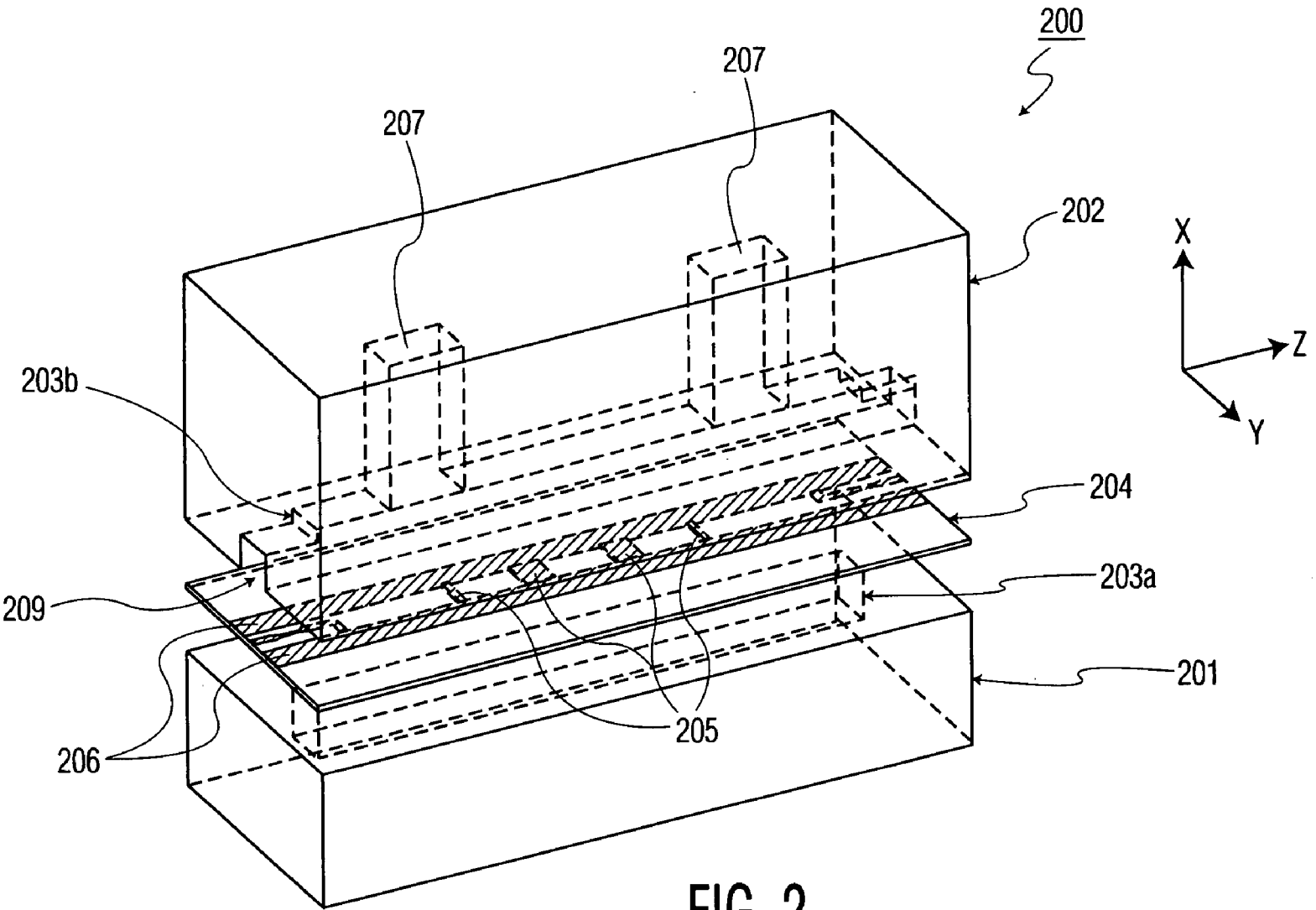
FIG. 2 is an exploded perspective view of a FINLINE type E plane band-pass filter according to a first embodiment of the present invention.
Figure 3:
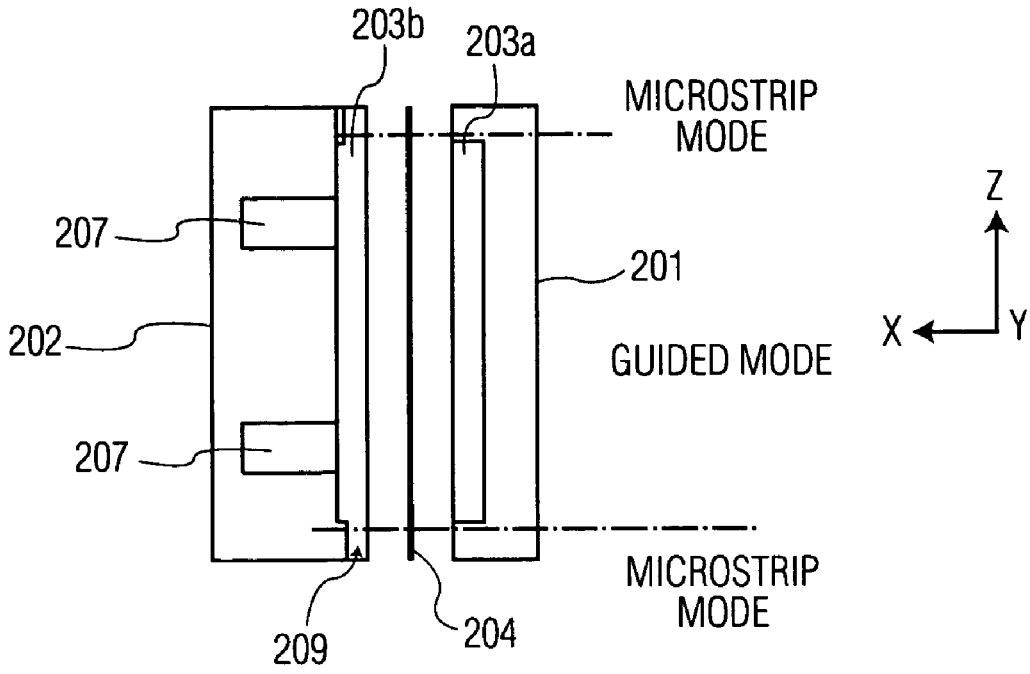
FIG. 3 is a view along the plane XZ of the filter of FIG. 2.
Figure 4:
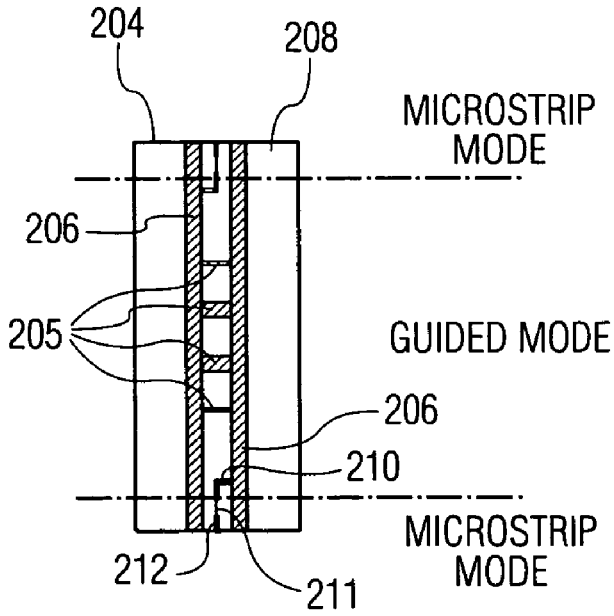
FIG. 4 is a plan view from above of the insulating substrate used in the filter of FIG. 2.

Referring to FIGS. 2 to 4, the filter 200 according to the invention comprises a base 201 and a cover 202, both made of metal. A rectangular waveguide 203 has been cast in the base and in the cover. More specifically, an incomplete half 203*a* of the waveguide is moulded in the base while the other incomplete half 203*b* is moulded in the cover, as clearly represented in FIGS. 2 and 3. In a known way, the waveguide is provided with a thin dielectric substrate 204 placed longitudinally in the E plane of this guide, that is, in the plane XY of FIG. 2. The top side of the substrate has four inserts 205. These inserts 205 are inductive inserts formed by relatively broad rectangular metallizations and are separated from each other by a distance roughly equal to half the guided wavelength. For the response of the filter to be less sensitive to the production tolerances, the inserts can be printed on both sides of the substrate. As represented in FIGS. 2 and 4, two metallized strips 206 are printed on the longitudinal edges of both sides of the substrate. The strips 206 include metallized holes, not represented, which are used to provide perfect ground continuity between the two parts 203*a* and 203*b* of the waveguide. The structure described above can be used to obtain the Chebyshev type band-pass filtering function. The dimensions and the positioning of the inserts are determined in a known way to obtain the required response curve. In this specific case, since there are four inserts, the filter is of order 3.

Figure 5A:
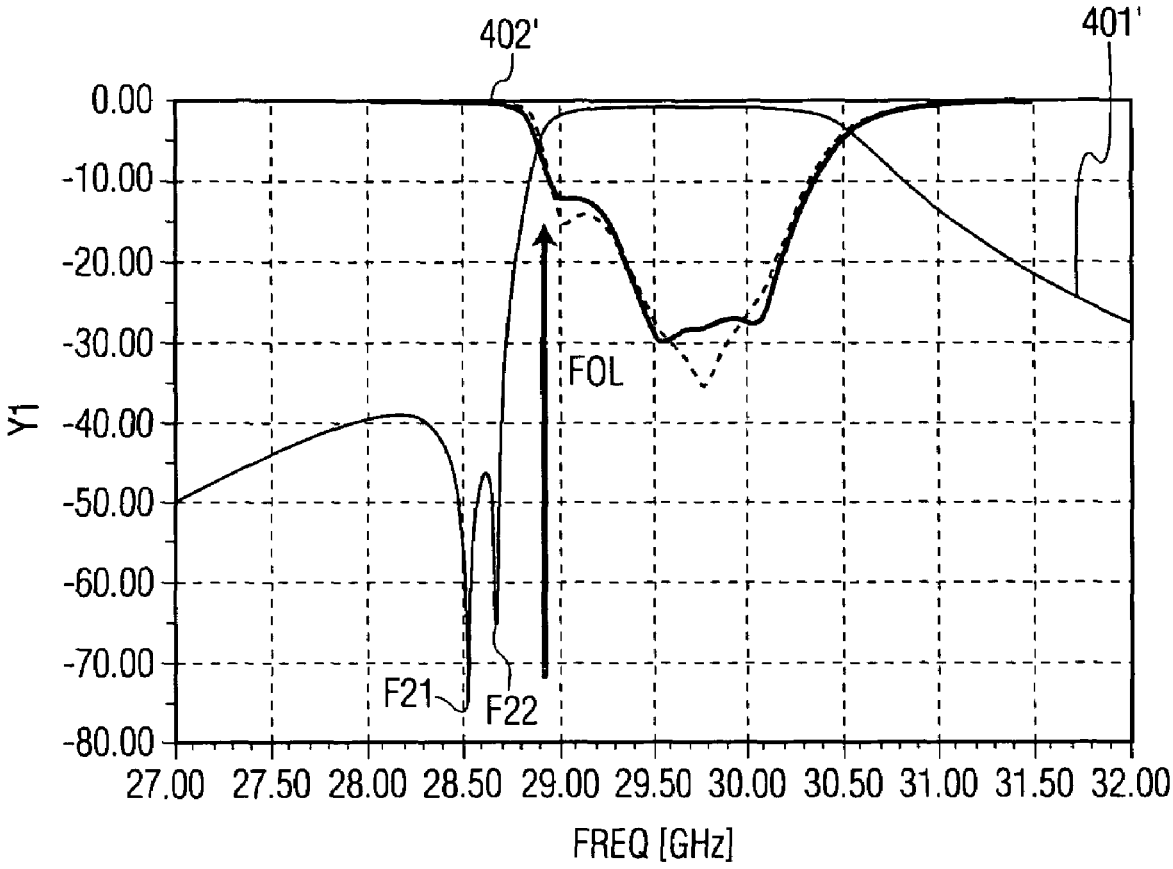
FIG. 5A represents the reflection curve of the filter of FIG. 2 and of a standard third order FINLINE type E plane band-pass filter.
Figure 5B:
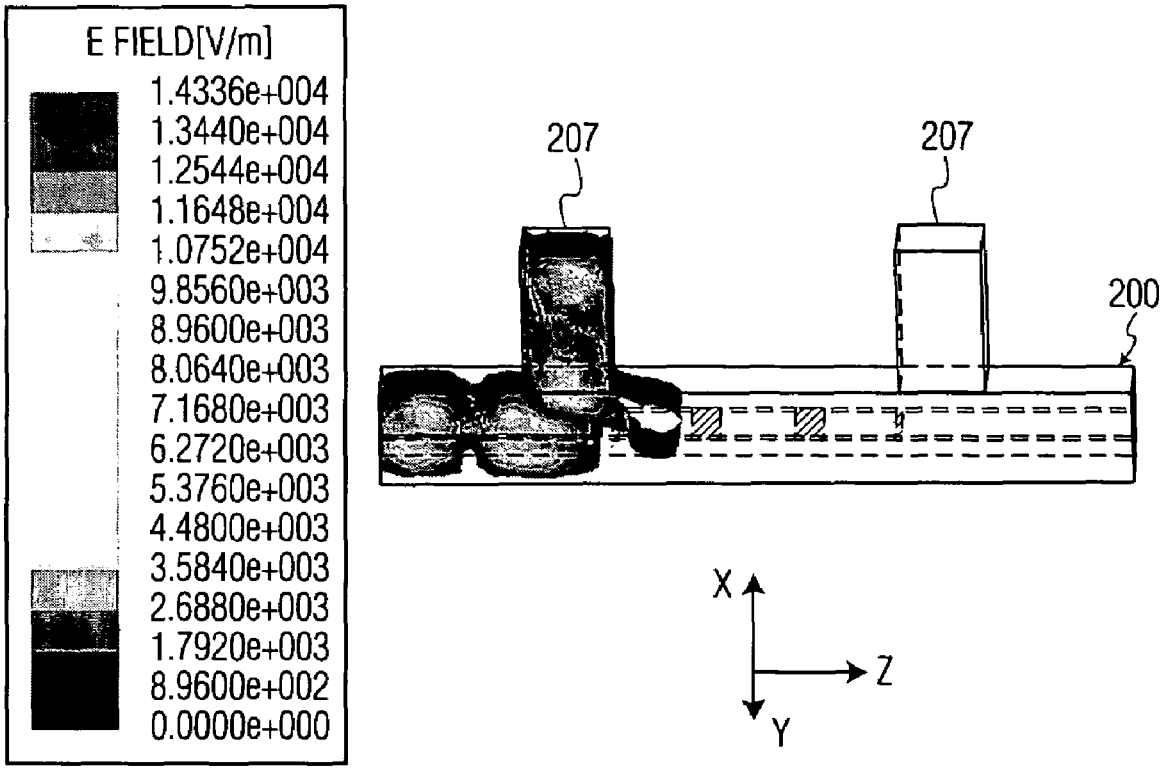
FIG. 5B represents a perspective view identical to that of FIG. 2 showing the role of the cavity at the frequency to be rejected.
Figure 6:
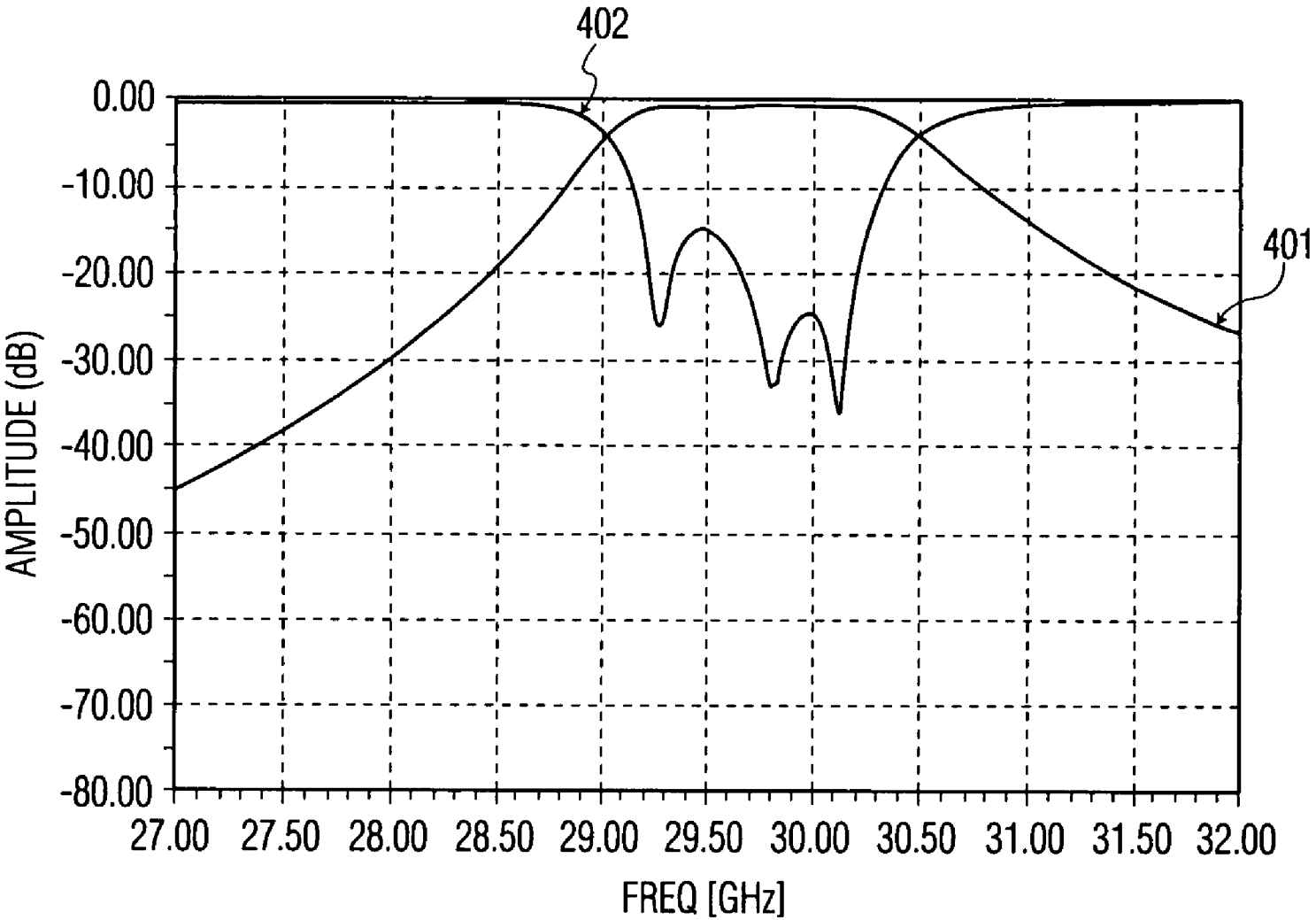
FIG. 6 represents the transmission curve of the filter of FIG. 2 and of a standard third order FINLINE type E plane band-pass filter.

Also, according to the present invention, two cavities 207 in short circuit are moulded in the cover 202 so as to be perpendicular to the substrate 204. Each cavity 207 is of a length equal to half the guided wavelength $\lambda Lg/2$ calculated at the given frequency (Fz), the guided wavelength being dependent on the section of the guide. These cavities each generate a zero of transmission around the frequency (Fz) to be rejected. Each cavity provides a short circuit respectively at the frequency Fz1 and Fz2 in the main axis of the guide and, because of this, cuts off the transfer of the signal almost entirely, as is shown in FIG. 5*b* which represents the iso-amplitudes of the electrical field in the filter at this frequency Fz1 which corresponds to the input cavity. The second cavity provided at the output generates a zero of transmission around the frequency Fz2 very close to the frequency Fz1, as can be seen in the curve 401' of FIG. 5A. The use of two cavities provides for a fairly wide rejection band around the required frequency to offset any drifts in the filter response due to the production tolerances. However, it is also possible to envisage a filter with a single input cavity, this cavity being provided with a means of adjusting the frequency Fz such as an adjusting screw.

Furthermore, as shown in FIGS. 2 and 3, the transition between the waveguide and the microstrip technology circuits is produced on the same substrate 204. More specifically, this transition comprises an inductive loop 210 exciting the fundamental mode of the guide. This loop is linked to an impedance matching line 211 produced using microstrip technology on one end of the substrate 204, the bottom side of which has been metallized and/or is in contact with the metallic base 201 to form a ground plane. The cover is provided with a recess 209 which extends the upper incomplete half 203*b* of the waveguide. The impedance matching line 211 is extended by a line of 50 ohms characteristic impedance 212 also produced using microstrip technology. This transition is made at both ends of the waveguide, as shown in the figures.

The filter represented in FIG. 2 corresponds to a particular embodiment implemented in a WR28 type standard waveguide of section $3.556 \times 7.112$ mm$^2$, provided with an inexpensive RO4003 type dielectric substrate 0.2 mm thick.

This filter is of order 3, with four conductive inserts, and these inserts have been calculated to obtain a passband conforming to that of a Ka type terminal, or 29.5-30.0 GHz. A filter of this type was simulated using the HFSS/ANSOFT 3D electromagnetic simulator. The simulation results are given in FIGS. 5A and 6, respectively in the case of a filter according to the present invention but without the two microstrip/waveguide transitions and in the case of a conventional FINLINE filter. The response curve of a filter with only conductive inserts is therefore solely of the Chebyshev type, and is represented by the curve 401 in FIG. 6. This curve then presents an attenuation zero about 28.50 GHz as shown by the curve 401' of FIG. 5A, in the case of a filter provided with two cavities in short circuit according to an embodiment of the invention. Each of the added cavities modifies the port impedances of the filter and, because of this, mismatches it. This is corrected by a redimensioning of the inserts.

The curves 402 and 402' represent the reflection losses which are very low and which demonstrate a good matching with a filter impedance of 50 Ohms.

Figure 7:
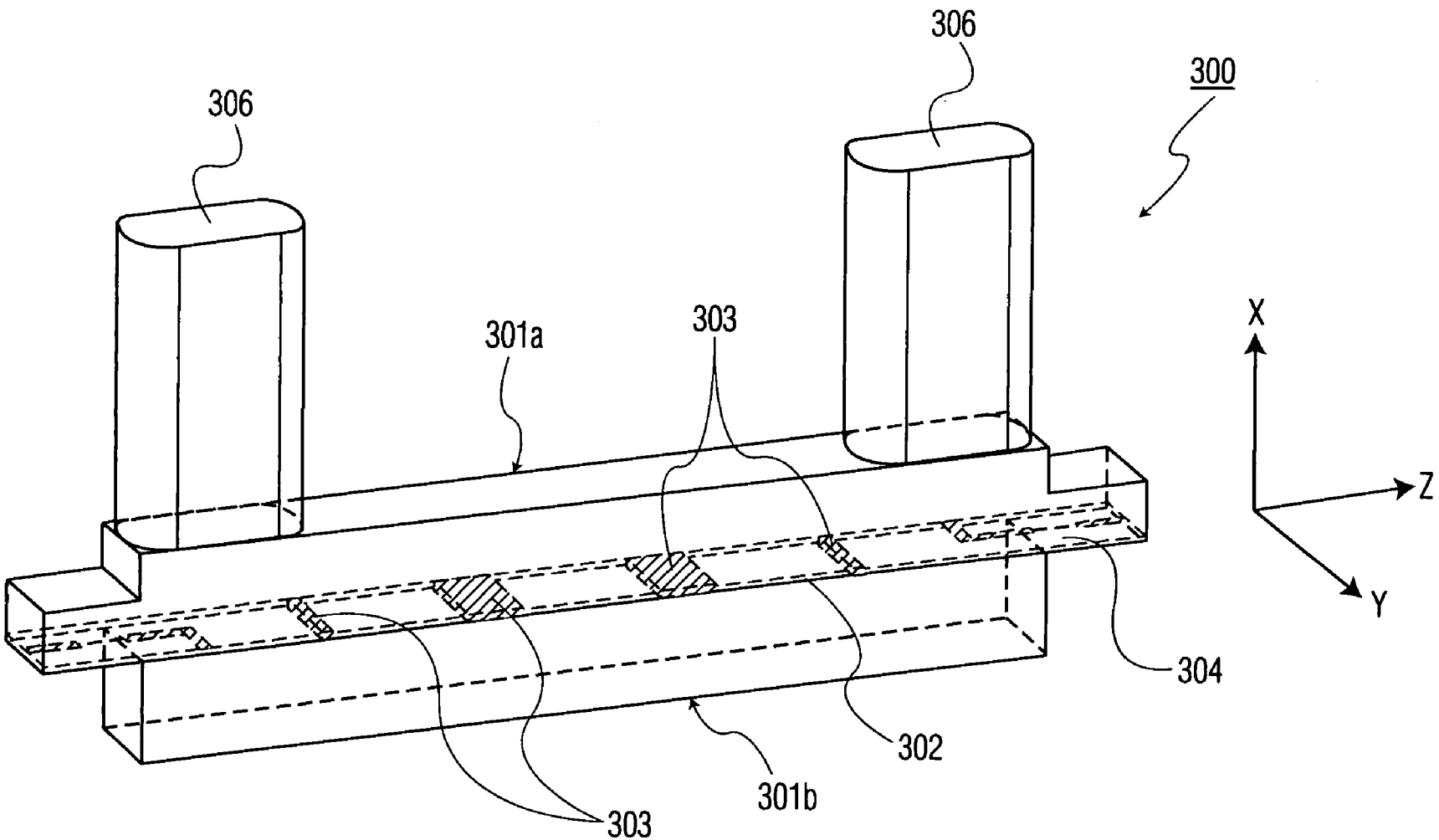
FIG. 7 is a perspective view of a second embodiment of a FINLINE type E plane band-pass filter according to the present invention.
Figure 8:
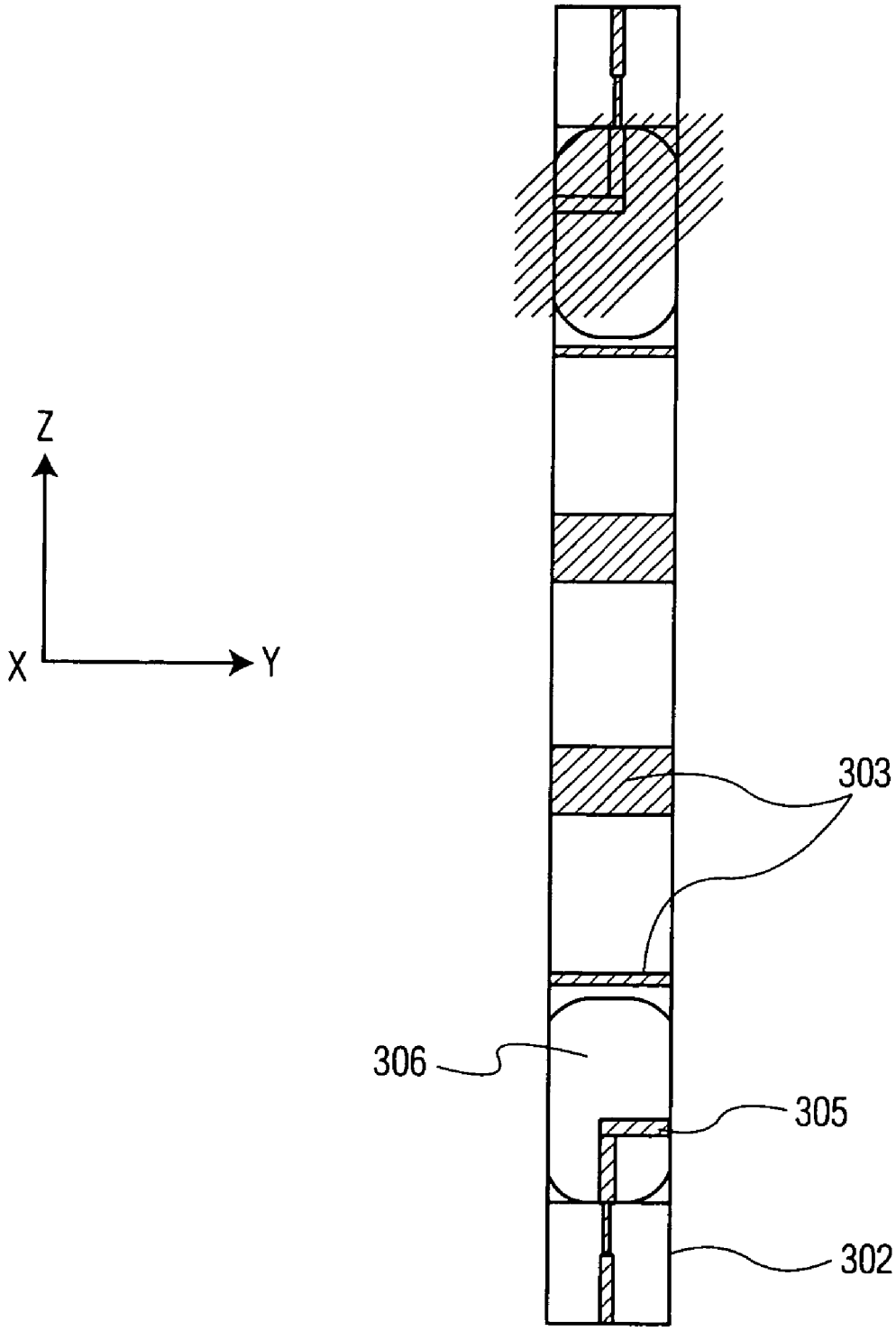
FIG. 8 is a plan view from above of the insulating substrate used in the filter of FIG. 7.
Figure 9:
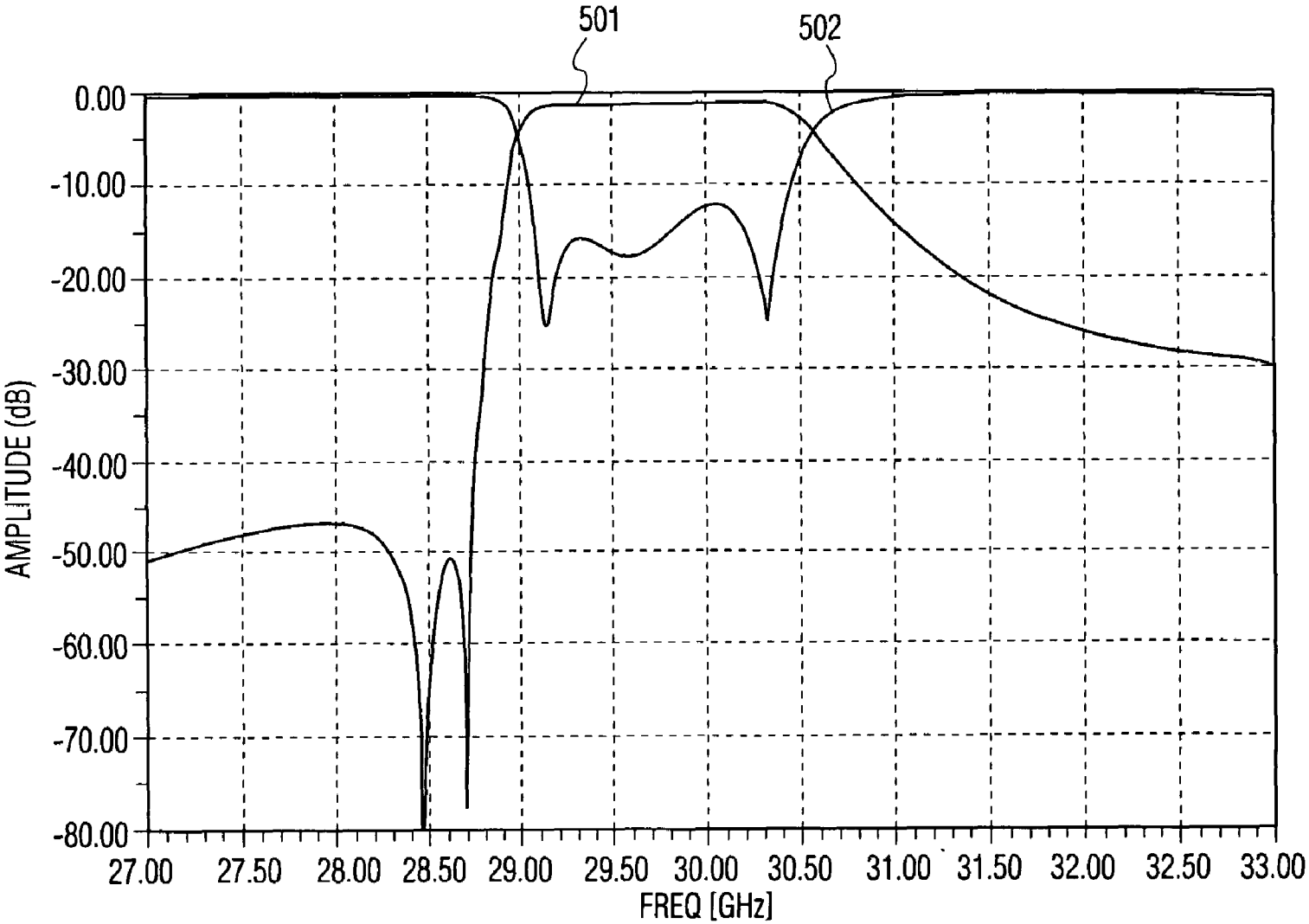
FIG. 9 shows the reflection and transmission curves of the filter of FIG. 7.

Thus, based on the results given by the curves of FIG. 5, the FINLINE type E plane band-pass filter offers the following performance levels:

insertion losses of approximately 0.8 dB matching>25 dB frequency attenuation at 28.55 GHz>45 dB image band attenuation>40 dB Another embodiment of the present invention will now be described with reference to FIGS. 7 to 9. In this case, the filter 300 comprises a rectangular waveguide 301 formed by two half-parts 301*a* and 301*b*. Between the two half-parts, a thin insulating substrate 304 is mounted, on which four inserts 303 have been metallized and the number and width of which determine the characteristics of the filter. The substrate is positioned on the propagation E plane of the filter. According to one aspect of the invention, the substrate is extended outside the waveguide part by a part 302 receiving the microstrip technology power supply lines as for the first embodiment. The transition 302 therefore includes an inductive loop 305 followed by an impedance matching line and a microstrip technology 50 Ohms line. In this embodiment, the cavities in short circuit 306 are provided directly above the inductive loops 305 as represented in FIGS. 7 and 8. This specific position can be used to further compact the filter. This embodiment was simulated as described above. The curves of FIG. 9 were obtained, among which the curve 501 shows an attenuation zero>50 dB for the frequency 28.50 GHz. The other curve 502 represents the reflection losses and demonstrates the good impedance matching of the filter.

The present invention can be applied to types of FINLINE type microwave band-pass filters other than that described specifically above.

It is obvious to a person skilled in the art that the FINLINE type E plane band-pass filter according to the present invention offers numerous advantages. In particular, it is more compact and less sensitive to the production tolerances than a conventional FINLINE filter and, being compatible with the printed circuit on organic substrate technology, it offers far lower insertion losses and is obtained at a much lower cost than the conventional filters.

The filter according to the present invention can be incorporated in particular in the transmission outdoor unit (ODU) of a user terminal to eliminate, in particular, the residual component in the transmission band which must not be radiated by the terminal. In this case, the outdoor unit includes at least one subharmonic mixer receiving on one input the RF signal, that is, a signal in the 0.95-1.45 GHz band for operation in the Ka band, from the indoor unit and, on the other input, a signal from a local oscillator operating in the Ku band, the output of the mixer being sent to a FINLINE type band-pass filter as described above.

It is obvious to a person skilled in the art that the filter of the present invention can also be used in systems other than the user terminals described above.

What is claimed is:

1. Microwave band-pass filter of type FINLINE comprising a waveguide divided longitudinally in two half-parts with an insulating substrate placed in an E plane of the waveguide between the two half-parts and comprising, on at least one side of the insulating substrate, conductive inserts electrically connected to internal surfaces of the waveguide, wherein the filter comprises at least one cavity perpendicular to the insulating substrate determining a zero of transmission at a frequency to be rejected.

2. Filter according to claim 1, wherein the filter comprises two cavities of identical or different shapes.

3. Filter according to claim 1, wherein the filter comprises one cavity provided with a frequency adjustment means to adjust the zero of transmission frequency.

4. Filter according to claim 3, wherein the one cavity is of a length equal to half the guided wavelength calculated at the zero of transmission frequency.

5. Filter according claim 1, wherein connections between the filter and processing circuits are made by a circuit comprising an inductive loop, an impedance matching line, and a 50 ohm characteristic impedance line, wherein the circuit is included on a portion of the insulating substrate that extends outside the waveguide.

6. Outdoor unit for transmission terminal comprising at least one subharmonic mixer and a local oscillator operating at a given frequency, the mixer receiving on a first input a signal to be sent and on a second input the signal from the local oscillator, wherein the output of the mixer is connected to a band-pass filter according to claim 1 to attenuate the frequency to be rejected.

* * * * *